US005264112A

United States Patent [19]

Dahms

[11] Patent Number: 5,264,112

[45] Date of Patent: Nov. 23, 1993

[54] ACIDIC NICKEL BATHS CONTAINING 1-(2-SULFOETHYL)-PYRIDINIUMBETAINE

[75] Inventor: Wolfgang Dahms, Berlin, Fed. Rep. of Germany

[73] Assignee: Atotech Deutschland GmbH, Berlin, Fed. Rep. of Germany

[21] Appl. No.: 941,432

[22] PCT Filed: Apr. 22, 1991

[86] PCT No.: PCT/DE91/00336

§ 371 Date: Nov. 19, 1992

§ 102(e) Date: Nov. 19, 1992

[87] PCT Pub. No.: WO91/16474

PCT Pub. Date: Oct. 31, 1991

[30] Foreign Application Priority Data

Apr. 23, 1990 [DE] Fed. Rep. of Germany ..... 4013349

[51] Int. Cl.[5] ..... C25D 3/12

[52] U.S. Cl. ..... 205/271; 205/275; 106/1.21; 106/1.27

[58] Field of Search ..... 205/271, 275, 279; 106/1.21, 1.27

[56] References Cited

U.S. PATENT DOCUMENTS

| | | | |
|---|---|---|---|
| 2,876,177 | 3/1959 | Gundel | 205/274 |
| 4,673,472 | 6/1987 | Morrissey | 205/257 |
| 5,024,736 | 6/1991 | Clauss et al. | 205/275 |
| 5,164,069 | 11/1992 | Cerwonka | 205/275 |
| 5,169,514 | 12/1992 | Hendriks et al. | 205/247 |

FOREIGN PATENT DOCUMENTS 1621157 5/1971 Fed. Rep. of Germany .

*Primary Examiner*—John Niebling
*Assistant Examiner*—Brian M. Bolam
*Attorney, Agent, or Firm*—Paul & Paul

[57] ABSTRACT

The invention concerns acid nickel baths containing 1-(2-sulfoethyl)-pyridinium betaine

11 Claims, No Drawings

ACIDIC NICKEL BATHS CONTAINING 1-(2-SULFOETHYL)-PYRIDINIUMBETAINE

The invention relates to acidic nickel baths containing 1-(2-sulfoethyl)-pyridiniumbetaine.

Acidic nickel baths are known, for example, from the publications U.S. Pat. No. 3,862,019, DE-PS 36 32 514, EP-A-0343 559, 5DD-PS 0266 814, and EP-A 0341 167.

It is also known that certain organic substances are added to acidic, and especially weakly acidic, nickel electrolytes in small quantities in order to achieve a bright nickel deposit instead of a dull deposit.

One group of additives, which are also called substratum brighteners, comprises unsaturated and usually aromatic sulfonic acids, sulfinic acids, sulfonamides and their salts as the case may be. The best-known compounds are, for example, m-benzenedisulfonic acid or benzoic sulfimide (saccharin).

Added to the electroplating bath alone, these additives (substratum brighteners) generate a bright but not leveled deposit over a certain range of current densities. Using them alone, therefore, has no practical meaning since the quality of the nickel coatings obtained with them does not meet current requirements.

Their obvious deficiency is the ability [sic] to level rough surfaces without making the deposit brittle.

Substances are also known here that are termed levelers.

They are practically always used with one or more substratum brighteners.

Known levelers are, for example, triply unsaturated alcohols or triply unsaturated amines. They show dark deposits in the low current density range, especially during continuous operation, even with a slightly excessive addition. It is even common for there to be no deposition in the low current density range and for the substrate material to remain visible.

Other known levelers are quaternary, aromatic, nitrogenous compounds such as pyridinium compounds or quinolinium compounds. The characteristic shared by all these levelers is that they make the nickel deposit brittle either at the very outset or, mostly, during continuous operation. In this way, subsequent shaping of the nickel-plated parts is no longer possible; cracks also emerge spontaneously which extend into the base material and thus cause corrosion (for example, rust).

The task of the present invention is to avoid the disadvantages which have been described and to provide a bath which—with adequate depth dispersion—prevents good leveling and the deposition of brittle deposits under long-term operation of the acidic nickel baths with minimal consumption of the bath ingredients.

This task is accomplished by the subject of the invention in accordance with the claims.

It was found that the addition of 1-(2-sulfoethyl)-pyridiniumbetaine

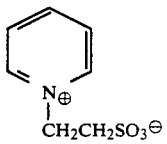

is particularly well-suited as a nickel brightener. 1-(2-sulfoethyl)-pyridinirumbetaine is a known substance (U.S. Pat. Specification No. 3,131,189; J. Org. Chem. 29, 2489 (1964); J. Org. Chem. 26, 4520 (1961)); it differs from 1-(3-sulfopropyl)-pyridiniumbetaine (DE-PS 1004011) in terms of its better effectiveness in starting and in terms of consumption.

With this compound, it is outstandingly possible to achieve very good leveling in conjunction with outstanding brightness. There is no brittleness. By combining the levelers in Table 2 with a triply unsaturated group, a bright plating region can be achieved down to the lowest current density region.

The bath for depositing nickel deposits formed by adding the substance according to the invention generally consists of a nickel salt solution to which a weak acid is added for buffering.

In practice, the Watts solution is primarily used with the following approximate composition:

200–400 g/l nickel sulfate ($NiSO_4.7H_2O$)
30–200 g/l nickel chloride ($NiCl_2.6H_2O$)
30–50 g/l boric acid ($H_3BO_3$)

The pH value is between 3 and 5.5 and primarily between 4 and 5. The temperature can be as high as 75° C. in order to increase current densities but, as a rule, it is between 50° and 60° C.

Heavy-duty electrolytes have a chloride content of 10–50 g/l and show the best results when using the compounds according to the invention. The nickel chloride can be replaced in part or in full by sodium chloride. With the designated heavy-duty electrolytes at 55° C., the current density can amount to as much as 10 A/dm$^2$.

Although the substance according to the invention can be added to the electrolyte alone, optimal results are achieved only by combining it with known substratum brighteners and levelers (Tables 1 and 2). In this way, excellent leveling can be achieved for the entire current density range required in practice without the deposits becoming brittle during continuous operation.

In the case of nickel electrolytes, the concentration of the compounds in accordance with the invention is very low and can lie between 0.005 and 5 g/l or, as a rule, between 0.05 and 0.4 g/l . The concentration is located in the lower range, in particular, if the compounds according to the invention are used in combination with substratum brighteners together with triply unsaturated compounds.

The substratum brighteners according to Table 1 are generally added to the electrolyte in quantities of 0.1–10 g/l. The levelers according to Table 2 are effectively added to give concentrations of between 0.005 and 0.25 g/l. Wetting agents can be added in amounts of up to 10 g/l to prevent a porous deposit.

TABLE 1

Examples of substratum brighteners (which are usually used in the form of their sodium salts or potassium salts) that can be added to the bath:

benzenesulfinic acid
m-benzenedisulfonic acid
phenylpropynesulfonic acid
vinylsulfonic acid
allylsulfonic acid
propynesulfonic acid
p-toluenesulfonic acid
p-toluenesulfinic acid
p-toluenesulfonamide
benzoic sulfimide
1,3,6-napthalenetrisulfonic acid
N- B/illegible/yl benzenesulfonamide butynediol sulfoacetate

TABLE 2

Examples of levelers that can be added to the bath:
propargyl alcohol
2-butynediol-(1,4)
ethylene glycol monopropargyl ether
ethylene glycol bispropargyl ether
diethylene glycol monopropargyl ether
N,N,-dimethylaminopropyne
N,N,-diethylaminopropyne
2-butynediol bis(hydroxyethylether)
2-butynediol mono(hydroxy-isopropylether)
2,5-hexynediol
2-(3-propyne-(1)-oxy)-propanol The following examples are intended to explain the invention in further detail.

EXAMPLE 1.0

0.25 g/l of the compound according to the invention is added to an electrolyte with the following composition
270 g/l nickel sulfate ($NiSO_4.7H_2O$)
40 g/l nickel chloride ($NiCl_2.6H_2O$)
40 g/l boric acid ($H_3BO_3$)
0.5 g/l sodium 2-ethylhexyl sulfate, as a wetting agent.

This addition alone produced a brightened and leveled deposit in a current density range of 2–5 A/dm$^2$. The test was conducted in the Hull cell at 55° C. with air injection A scratched copper sheet 7×10 cm in size was electroplated in 10 minutes at 2.5 amperes.

EXAMPLE 1.1

In addition to the compound according to the invention as a substratum brightener, 1 g/l of saccharin in the form of its sodium salt is added to the electrolyte in Example 1 0. The sheet shows a high luster and well-leveled deposit in the current density range of 2–8 A/dm$^2$.

EXAMPLE 2.0

0.1 g/l N,N-diethylaminopropyne and 1 g/l of saccharin (the sodium salt of benzoic sulfamide) is added to an electrolyte with the composition
250 g/l nickel sulfate ($NiSO_4.7H_2O$)
80 g/l nickel chloride ($NiCl_2.6H_2O$)
40 g/l boric acid ($H_3BO_3$)
35 0.5 g/l sodium 2-ethylhexyl sulfate, as a wetting agent.

A bright, somewhat leveled deposit is achieved in the current density range of 0.1–6 A/dm$^2$. By adding only 0.1 g/l of the compound according to the invention, a high luster and very well-leveled deposit is achieved in this range.

EXAMPLE 2.1

If the N,N-diethylaminopropyne in Example 2.0 is replaced by 0.07 g/l 2-butynediol-(1,4), then a high luster and very well-leveled deposit is achieved in the range from 0.3 to 8 A/dm$^2$.

EXAMPLE 2.2

If the N,N-diethylaminopropyne in Example 2.0 is replaced by 0.05 g/l 2-butynediol-bis-hydroxyethylether-(1,4), then a high luster and very well-leveled deposit is achieved in the range from 0.2 to 8.2 A/dm$^2$.

EXAMPLE 2.3

If the N,N-diethylaminopropyne in Example 2.0 is replaced by 0.03 g/l ethylene glycol monopropargyl ether, the a high luster and very well-leveled deposit is achieved in the range from 0 2 to 8.2 A/dm$^2$.

EXAMPLE 2.4

If the N,N-diethylaminopropyne in Example 2.0 is replaced by 0.007 g/l propargyl alcohol, then a high luster and very well-leveled deposit is achieved in the range from 0.3 to 7.2 A/dm$^2$.

EXAMPLE 2.5

If the N,N-diethylaminopropyne in Example 2 0 is replaced by 0.15 g/l sodium hydroxypropynesulfonate, then a high luster and very well-leveled deposit is achieved in the range from 0.1 to 8 A/dm$^2$.

EXAMPLE 2.6

If the N,N-diethylaminopropyne in Example 2.0 is replaced by 0.05 g/l sodium propynesulfonate, then a high luster and very well-leveled deposit is achieved in the range from 0.2 to 9 A/dm$^2$.

EXAMPLE 2.7

If the N,N-diethylaminopropyne in Example 2.0 is replaced by 0.29 g/l sodium vinylsulfonate, then a high luster and very well-leveled deposit is achieved in the range from 0.1 to 10 A/dm$^2$.

EXAMPLE 3

An electrolyte with the following composition
270 g/l nickel sulfate ($NiSO_4.7H_2O$)
40 g/l nickel chloride ($NiCl_2.6H_2O$)
40 g/l boric acid ($H_3BO_3$)
0.5 g/l sodium 2-ethylhexyl sulfate, as a wetting agent
1 g/l of the sodium salt of saccharin
1 g/l formalin (37%) and
0.3 g/l of the compound according to the invention is subjected to 4 A/dm$^2$ in a continuous operation. The deficiency in the quantities of additives is supplemented in each case after testing in the Hull cell. Consumption is around 50 g of the compound in accordance with the invention based on a charge throughput of 1000 Ah.

EXAMPLE 3.1

If the compound according to the invention in Example 3 is replaced by 1-(3-sulfopropyl)-pyridiniumbetaine, then a consumption of 60 g is measured based on a charge throughput of 1000 Ah. In this way, a saving in quantity is achieved with the compound according to the invention with an identical electroplating effect.

I claim:

1. Acidic nickel baths containing 1-(2-sulfoethyl)-pyridiniumbetaine.

2. Acidic nickel baths according to claim 1, containing 1-(2-sulfoethyl)-pyridiniumbetaine in a concentration of 0.005 to 5 g/l.

3. Acidic nickel baths according to claims 1 and 2, containing substratum brighteners in concentrations of 0.005 to 10 g/l.

4. Acidic nickel baths according to claims 1 and 2, containing levelers in concentrations from 0.005 to 0.25 g/l.

5. Acidic nickel baths according to claim 4, containing propargyl alcohol in concentrations from 0.01 to 0.15 g/l.

6. Acidic nickel baths according to claim 4, containing 2-butynediol-(1,4) in concentrations from 0.02 to 0.25 g/l.

7. Acidic nickel baths according to claim 4, containing ethylene glycol monopropargyl ether in concentrations from 0.01 to 0.1 g/l.

8. Acidic nickel baths according to claim 4, containing N,N,-diethylaminopropyne in concentrations of 0.02 to 0.25 g/l.

9. Acidic nickel baths according to claim 4, containing 2-butynediol-bis-(hydroxyethylether) or 2-butynediol mono(hydroxy-isopropylether) in concentrations of 0.02 to 0.25 g/l.

10. Acidic nickel baths according to claim 4, containing hydroxypropynesulfonic acid, or 2,5-hexynediol or its salts in concentrations from 0.02 to 0.25 g/l.

11. Acidic nickel baths according to claims 1 and 2, containing wetting agents in concentrations from 0 1–10 g/l.

* * * * *

UNITED STATES PATENT AND TRADEMARK OFFICE

CERTIFICATE OF CORRECTION

PATENT NO. : 5,264,112
DATED : November 23, 1993
INVENTOR(S) : Wolfang Dahms

It is certified that error appears in the above-indentified patent and that said Letters Patent is hereby corrected as shown below:

Column 3, line 31 after air injection insert a period (end of sentence);

Column 3, line 39 Example 1 0. should be 1.0;

Column 3, line 50 sentence starts 35 0.5 - the 35 was our line numbering - needs to be deleted;

Column 4, line 6 range from 0 2 should be 0.2;

Column 4, line 15 Example 20 should be Example 2.0;

Column 6, line 12, Claim 11 - after concentrations from 0 1 should be 0.1

Signed and Sealed this

Twenty-eighth Day of June, 1994

*Attest:*

Bruce Lehman

BRUCE LEHMAN

*Attesting Officer*

*Commissioner of Patents and Trademarks*